US009321470B1

(12) United States Patent
Riden

(10) Patent No.: US 9,321,470 B1
(45) Date of Patent: Apr. 26, 2016

(54) SYSTEMS AND METHODS FOR IMPLEMENTING OBJECT COLLISION AVOIDANCE FOR VEHICLES CONSTRAINED TO A PARTICULAR PATH USING REMOTE SENSORS

(71) Applicant: ROCKWELL COLLINS, INC., Cedar Rapids, IA (US)

(72) Inventor: Vincent Riden, Porter, TX (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 121 days.

(21) Appl. No.: 14/285,596

(22) Filed: May 22, 2014

(51) Int. Cl.
*G08B 21/00* (2006.01)
*B61L 23/34* (2006.01)

(52) U.S. Cl.
CPC ..... *B61L 23/34* (2013.01)

(58) Field of Classification Search
CPC ..... B61L 23/34
USPC ..... 340/435, 436, 463; 246/11, 114 R, 115; 701/19, 301
See application file for complete search history.

(56) References Cited

U.S. PATENT DOCUMENTS 6,163,755 A * 12/2000 Peer et al. ..... 701/301
6,323,785 B1 * 11/2001 Nickell et al. ..... 340/933
2008/0073466 A1 * 3/2008 Mardirossian ..... 246/125

* cited by examiner

*Primary Examiner* — Jeffrey Hofsass
(74) *Attorney, Agent, or Firm* — Ronald E. Prass, Jr.; Prass LLP

(57) ABSTRACT

A system and method are provided for implementing advanced object collision avoidance for vehicles traveling on a constrained path, including rail vehicles traveling on tracks as a track intrusion detection system (TIDS). The disclosed schemes leverage certain commonly-installed communications nodes to provide a communication network between a plurality of laser detector scanner units, a remote monitoring facility and one or more vehicles operating on a constrained path, including a track. A detection of a track intrusion event is made by the laser detector scanner unit and communicated to the remote monitoring facility for analysis. As a result of the analysis, an automated warning may be communicated directly to a vehicle in-cab warning device and/or to fixed warning beacons on track sections in a vicinity of the track intrusion event to alert the operator of a need to take emergency action.

17 Claims, 3 Drawing Sheets

SYSTEMS AND METHODS FOR IMPLEMENTING OBJECT COLLISION AVOIDANCE FOR VEHICLES CONSTRAINED TO A PARTICULAR PATH USING REMOTE SENSORS

BACKGROUND

1. Field of the Disclosed Embodiments

This disclosure relates to systems and methods for implementing advanced object collision avoidance for vehicles traveling on a constrained path, including rail vehicles traveling on tracks as a track intrusion detection system (TIDS).

2. Related Art

Despite significant railway and subway safety vigilance, an unfortunate continuing problem exists with people being injured and killed on railway and subway tracks. Many of these unfortunate occurrences arise when one passenger may inadvertently (and, in a small number of cases, purposefully) push another passenger onto the tracks. Railway and transit control and operating agencies continue to seek systems that provide additional track surveillance and early warnings of track obstructions with an objective of stopping trains in an event of passengers jumping, falling, or being pushed onto the tracks in front of oncoming trains.

Albeit that these are severe problems and tend to grab local and national headlines, the railway and transit control and operating agencies, like many other industry agencies nationwide and worldwide, struggle with balancing limited resources spread across a broad spectrum of operating requirements. As such, reasonable accommodation to safety requires that these agencies dedicate resources to the difficulties associated with individuals ending up on a track bed in front of an oncoming train, at the expense of devoting those resources to other operational requirements. Resources, for example, must be dedicated to simply maintaining the trains, the tracks, and the supporting facilities, as well as to reasonable attempts to maintain a safe operating environment.

SUMMARY OF THE DISCLOSED SUBJECT MATTER

With advances being made across a broad spectrum of technologies, including sensor, surveillance, communication and visual/auditory/tactile warning components, opportunities may exist to optimize these various components into a surveillance and warning system that is capable of (1) detecting a presence of an object or individual in a path of an oncoming train in a more timely manner and (2) communicating such a detection to an authority, including to a vehicle operator to command an emergency stoppage of the vehicle in an effort to avoid damage to the vehicle from the object or injury or death to the individual.

In searching for increasingly vigilant systems, equal weight must be paid to the detection components, the communication components and the alert components in order to ensure that information is passed in a timely enough manner to effect stoppage of the vehicle. Such systems should be deployed particularly in areas of high passenger, personnel or pedestrian traffic to accommodate local passenger, personnel and/or passenger safety. Because there is always a cost motive, any additional detection and reporting system should be implemented at as comparatively as low a cost as possible in order to balance competing requirements of effectively and efficiently providing secure and safe transport for all passengers, as well as maintaining security and safety for railway and track workers.

Many railway and transit control and operating authorities employ closed-circuit television (CCTV) systems, which may include some amount of video analytics, that are generally monitored remotely at a central control facility.

Of late, particularly in areas where new sections of track may be installed through newly-prepared tunnel portions, certain security systems have been installed to limit unauthorized access to largely unmonitored construction and operations areas. Some benefit has been found by employing one or more laser intrusion detection systems or LIDS. New York City Transit, for example, has employed laser intrusion technologies at a number of its Port Authority Trans-Hudson (PATH) locations. Laser intrusion technology has been installed for example at a station platform edge at certain tunnel portals to provide a detections system for monitoring and responding to unauthorized individuals attempting to enter certain restricted track areas, including and particularly the tunnels. The LIDS essentially takes a laser scanner that was known in the machining arts and adapts it as an object and motion detector for security purposes.

The LIDS sensors may be situated to scan across a tunnel opening to provide substantially continuous coverage of the tunnel opening. Laser sensors employed in certain security applications are able to discern how large and how far away an object may be from the sensor, and a velocity of any movement that the object may exhibit, as the object obstructs the field of view of the laser sensor, cutting its beam.

New York City Transit installed these security systems not only for their own security, but further in response to mandates from the U.S. Department of Homeland Security that any tunnel that goes under a river must have an intrusion detection system, including a scanner, emplaced at an end of any platform leading to a tunnel opening.

Based on the ongoing work being performed in these tunnels, and in order to avoid false intrusion alerts, separate keypads were provided by which employees and contractors could scan certain credentials to temporarily deactivate the sensor systems to permit passage through the tunnel openings in either direction. Standard secure area access and egress protocols were employed.

A particular laser scanner unit was adapted for the above purposes in providing access control. A shortfall in the particularly-employed unit, however, was that a programmable logic controller or PLC was required to function, or to derive detection/alarm signals from the laser scanner unit. So, these two components combine as a functional component or extension accessory to a security system. In view of the above, it may be advantageous to develop a track intrusion detection system (TIDS) that may adapt and proliferate components of the security systems for inhibiting undetected tunnel intrusion to address a particular need for increased vigilance to curtail the spate of individuals dying on tracks. The disclosed TIDS concept, scheme, system components and methods have been developed through extensive research into adaptation of, and communication with, certain scanner systems dedicated to other security purposes that do not require a PLC to function.

Exemplary embodiments of the systems and methods according to this disclosure may install an interactive plurality of periodically, or interval placed, laser sensors to cover multiple track sections along a railway or subway track line, particularly those track sections that are located in stations and in other areas where there is a high pedestrian, personnel or passenger populace.

Exemplary embodiments may employ the plurality of laser sensors to provide track coverage to detect a position or movement of an object on or in a vicinity of a track bed.

Exemplary embodiments may optimally emplace the plurality of laser sensors to be relatively easily maintained while limiting access to the sensors by non-maintenance personnel.

Exemplary embodiments may emplace the laser sensors optimally to reduce any false positive indications of objects on the track bed that may be triggered by passenger, or other personnel, movement in a vicinity of the track bed, such as on a passenger waiting platform.

Exemplary embodiments may deploy the disclosed track intrusion detectors on a dedicated network that reduce hardware and labor by not requiring a PLC.

Exemplary embodiments may use the laser sensors to detect track bed obstruction or intrusion, and to report detected instances to local or remote operator situational awareness displays via a server. These local or remote situational awareness displays may include, for example, some manner of monitored graphical user interface In embodiments, the operator situational awareness displays may aggregate signals from myriad systems and sub-systems providing different elements of information for local or remote operator situational awareness monitoring including, railway system track bed monitoring.

Exemplary embodiments may detect presence or movement of an object larger than a cellular telephone that breaks the beam and finds its way onto the track bed.

Exemplary embodiments may provide some manner of in-cab or track bed warning system that may be automated to react to sensor detection of an object or an individual in the path of the vehicle, including a train, and to provide to the vehicle operator sufficient warning to take corrective action, generally in the form of commanding an emergency stop of the vehicle.

These and other features and advantages of the disclosed systems and methods are described in, or apparent from, the following detailed description of various exemplary embodiments.

BRIEF DESCRIPTION OF THE DRAWINGS

Various exemplary embodiments of the disclosed systems and methods for implementing advanced object collision avoidance for vehicles traveling on a constrained path, including rail vehicles traveling on tracks (e.g. TIDS) and potentially aircraft on a runway, will be described, in detail, with reference to the following drawings, in which.

DESCRIPTION OF THE DISCLOSED EMBODIMENTS

Figure 1:
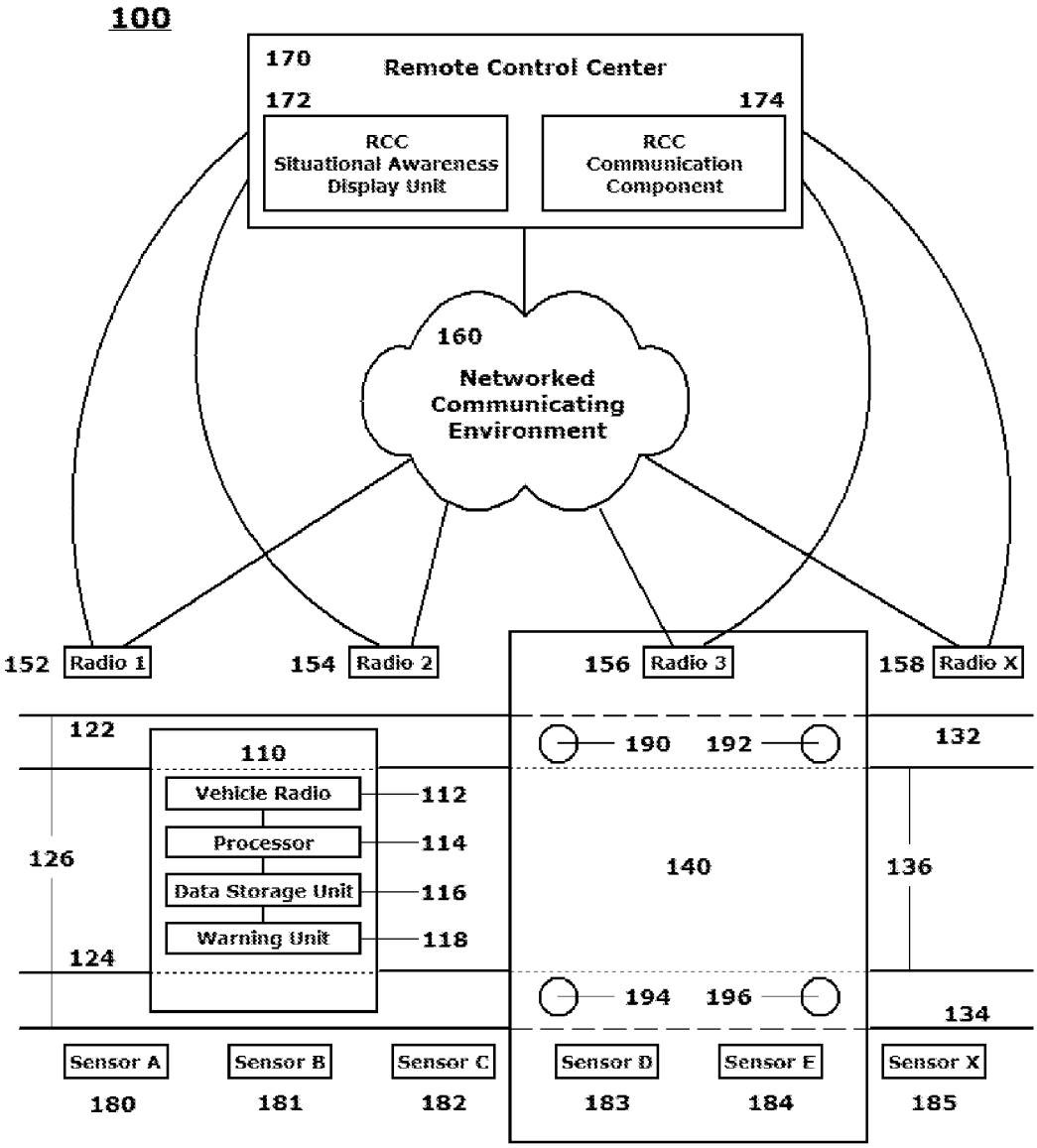
FIG. 1 illustrates an exemplary overview of an operating environment including systems for facilitating the detecting, communicating and warning schemes for object avoidance by constrained movement vehicles according to this disclosure.

The disclosed systems and methods for implementing advanced object collision avoidance for vehicles traveling on a constrained path, including rail vehicles traveling on track beds as a TIDS, will generally refer to this specific utility for those systems and methods. Exemplary embodiments will be described and depicted in this disclosure as being particularly adaptable to use on trains whose range of movement is, of course, restricted to movement along a train track. These descriptions and depictions should not be interpreted as specifically limiting the disclosed schemes to any particular configuration of a moving vehicle. In fact, the systems and methods according to this disclosure may be equally applicable to movements of vehicles, bodies, units and individuals where those movements are particularly constrained to a defined path way or pattern of path ways that may be effectively monitored at least in part by a system of sensors intended to discern objects falling into the path of an oncoming vehicle, including, for example airplanes on runways or taxiways at an airport. Any ability to augment a vehicle, body, unit or individual with an appropriate detecting, communicating and warning system for signaling an object obstruction sensed by a real-time sensor, and automatically communicating a warning to a vehicle operator via a locally established wireless communication means that may benefit from object detection along the defined path way is contemplated.

Specific reference to, for example, any particular object sensor component, any wired or wireless communicating component and/or any particular wireless communication protocol, any particular configuration of a local or remote situational awareness display, and/or any particular implementation of a visual/auditory/tactile warning component presented in this disclosure should be understood as being exemplary only, and not limiting, in any manner, to any particular class of respective devices as the above terms are understood by those of skill in the arts of detection, communication and warning systems.

Features and advantages of the disclosed embodiments will be set forth in the description that follows, and in part will be obvious from the description, or may be learned by practice of the disclosed embodiments. The features and advantages of the disclosed embodiments may be realized and obtained by means of the instruments and combinations of features particularly pointed out in the appended claims.

Various embodiments of the disclosed systems, methods, processes and schemes are discussed in detail below. While specific implementations are discussed, it should be understood that this is done for illustration purposes only. A person skilled in the relevant art will recognize that other components and configurations may be used without departing from the spirit and scope of the disclosed embodiments.

A number of companies produce laser scanners with essentially the same operating specifications as those that were adapted by NYT, but that do not require a PLC, and that rather include network interface connections to connect the laser scanner directly to a network. Additionally, certain of these scanners may also include direct supervisory and alarm connections to provide for "old school" wired connections to the laser scanner units. Direct connections are often favored, at least as a backup to wireless communications, by transit/rail organizations.

Security perimeter laser scanner units may include laser scan detectors that can detect a moving object's size, speed, and distance from the unit and that can process the detection information with unique algorithms. This results, for example, in a high-reliability detection of people attempting to gain unauthorized access to a secure area guarded by the security perimeter laser scanner, with minimal false alarms. In installations, these laser scanner units are often designed to create a detection area that functions as an invisible wall. These laser scanner units may be configured or adapted to operate in a horizontal detection mode. These laser scanner units may thus comprise a self-contained unit that may provide network-connected monitoring at relatively low installation cost. The selected laser scanner unit may be configured and operated to provide a wired or wireless communication link to a local or remote monitoring facility, which may, in turn, trigger a warning device to advise a vehicle operator of a detected obstruction breaking the beam of the laser scanner unit.

Exemplary embodiments may focus on modern wireless communicating technologies that may be available to replace or to supplement other conventional communicating means for moving vehicles. In embodiments, information regarding an obstruction on a track may be detected relative to a position of a vehicle. That information may be provided to a specified central monitoring facility tracking a particular location of one or more vehicles along particular path ways or throughout a pattern of path ways.

Exemplary embodiments may leverage a widespread proliferation of Wi-Fi-type wireless communicating devices including, for example, Wi-Fi base stations that may be varyingly mounted in fixed locations, including train stations, and separately and correspondingly located in all types of vehicles. In a simplest context, the disclosed schemes anticipate that Wi-Fi radios in vehicles, each with a particular radio identifier, may establish single-point short range communication with one or more fixed Wi-Fi stations at known positions such as, for example, in train stations, to localize a position of the vehicle with respect to the one or more fixed Wi-Fi stations with which the Wi-Fi radio in the vehicle may be communicating at any particular time.

With the availability of the above commercial-off-the-shelf (COTS) and consumer grade laser scanner units and wireless communicating systems, network connections may be made available to provide a networked detection, communication and warning systems. This addresses, among other issues, the currently unanswered challenge that arises because railway or transit control and operating agencies do not possess the technology in their remote control centers to effectively and automatically warn the agencies in general, and relevant vehicle operators in particular, of a track intrusion incident in time for the vehicle operator to take action to avoid the track intrusion object. The challenges may include (1) getting an alarm signal to a train operator directly (via, for example, Track Worker Safety System, or un updated radio approach); (2) getting an alarm signal to a local station operator and/or paralleling the signal to the remote control center; and/or (3) getting an alarm signal directly to the remote control center in order that remote control center personnel may be afforded an opportunity to deal with the alarm and response. The disclosed system may provide a turnkey, future proof, and maintenance friendly system to address the above challenges and to support future expansion. The proposed solution is all COTS providing selected laser scanner units (augmented with, for example, platform and track bed cameras), extensive cooperating wireless communicating nodes, servers with video analytics, existing track worker safety systems, and SPAD-like or -based beacons on the tracks, platform edges and/or station and tunnel ceilings. An advantage of the proposed schemes is found in effective integration of these components into an overall system that increases station and other congested area trackside safety.

The disclosed embodiments provide comprehensive end-to-end platform edge coverage with track intrusion event alarms that may be sent simultaneously to a remote control center and to a specified train cab/operator. The disclosed system design may include, for example, laser detector scanner units placed approximately 100 feet apart, or otherwise optimally as needed, along the track bed for the length of the platform with the laser scanners pointed over the tracks and the detectors mounted on the far side of the tracks in certain high passenger/personnel/pedestrian traffic areas. The laser detector scanner units may communicate with local or remote integrated situational awareness display units over a communication network, and particularly to one or more situational awareness display units located in a remote control center (RCC). Each of the laser detector scanner units may be hard-wired to the network (or possibly adapted wirelessly to communicate via a Wi-Fi or other protocol LAN). The train cab/operator alert may be provided by modifying a currently-available Track Worker Safety System to deliver an alert regarding a track intrusion event directly to the train operator in the train cab. Separately, auditory warning signals may be provided over a radio system, or may be provided by some form of dashboard indicator in which an audible piezoelectric horn may alert the train operator to apply the brakes to a full stop.

Signal Past At Danger (SPAD) type track tie beacons may be appropriately deployed as visual indicators that may be centered between the rails, and/or supplemented by additional beacons that may be mounted overhead of the platform edge that illuminate (synchronously or not) only on occurrence of a track intrusion event that is detected and verified by laser detector scanner units and potentially checked against, or confirmed by, video analytics.

In embodiments, fixed communicating nodes or radios can be placed inside tunnels upstream of platforms, for example, so the train (vehicle) mounted communicating nodes or radios may join the network well before arrival at the station, platform or other area susceptible to individual or object obstruction of the train. CCTV cameras may continue to be placed where needed to capture video of the track bed, even while other cameras may be deployed to cover the platform, as appropriate. Data storage may be provided locally or in the RCC as desired by the railway or train control and operating agency on a server, for example, or in enterprise or cloud storage. The video analytics may be effected by the servers as a cross-check to and/or a secondary backup for the primary sensors, i.e., laser detector scanner units, on the track bed, and to assess platform passenger loading as well. If both a laser detector scanner unit and a video analytic are positive for a fouled track, the situational awareness display and associated system may light beacons, alarms and video at the RCC, and alert the train operator, all simultaneously.

FIG. 1 illustrates an exemplary overview of an operating environment 100 including systems for facilitating the detecting, communicating and warning schemes for object avoidance by constrained movement vehicles according to this disclosure. As shown in FIG. 1, the exemplary operating environment 100 is intended to follow the operations of one or more vehicles 110 constrained to operations along at least one of (1) a constrained path 126 with boundaries 122 and 124 or (2) a track 136 with rails 132 and 134. This depiction is not intended, in any way, to exclude other constructs, including monorails and other like movement restricting paths.

Each vehicle 110 may include a vehicle radio 112, which may be any wireless device installed in, mounted on, or otherwise associated with, the vehicle 110 for communicating with a plurality of trackside or path-side fixed radio installations 152,154,156,158, including fixed radio installations in one or more stations 140. The vehicle radio 112 may be configured to communicate, via a wired or wireless connection within the vehicle 110.

Each vehicle radio 112 in each vehicle 110 may communicate via an antenna mounted externally on the vehicle body and may be configured to cooperatively communicate sequentially with each of the trackside or path-side fixed radio installations 152,154,156,158 as the vehicle 110 passes each of those installations. The each vehicle radio 112 and the each of the trackside or path-side fixed radio installations 152,154, 156,158 may be configured as a wireless access point. Each of the trackside or path-side fixed radio installations 152,154, 156,158 may be arranged at fixed (known) locations along the track or path. The each vehicle radio 112 and the each of the trackside or path-side fixed radio installations 152,154,156, 158 may be encoded with a known unique identifier such that, when communications are established between one or more of the vehicle radio(s) 112 and the fixed radio installations 152,154,156,158, these communications may provide a method for determining a position of the vehicle 110.

The disclosed embodiments may preferably extensively piggy-back on deployment and use of Wi-Fi or other protocol LAN hardware that is intended to be ever more widely-deployed to support multi-channel communications for railway, subway and train applications. Each cooperating fixed radio installations 152,154,156,158 and vehicle radio 112 is intended to be capable of spanning a variety of communicating applications. Placing fixed radio installations 152,154, 156,158 in the tunnels upstream of a platform or station 140 allows the train to join the network before it arrives at the platform. The communications may be according to a Wi-Fi or WiGig protocol, or any other like communication protocol, that may establish a handshake between the vehicle radio 112 and the fixed radio installations 152,154,156,158.

Each vehicle 110 vehicle radio 112 installation may be connected to an in-vehicle processor 114, an in-vehicle data storage unit 116, and one or more in-vehicle warning units 118. There may also be, associated with the in-vehicle systems, one or more monitoring cameras (not shown) to monitor the vehicle operator or to survey the operator's field of view out the windshield of the vehicle. The video from such camera(s) may be stored locally data storage unit 116 in the cab for offloading subsequently, or may be transmitted and stored to another server. The one or more in-vehicle warning units 118 may include, for example, a piezoelectric or other sounder device for providing an audible warning, a light emitting diode (LED) or other lighted indicator for providing a visual warning, and/or a vibrating component "shaker" system mounted on a control console, or to an operator seat, to provide a tactile/haptic warning. As will be described in greater detail below, these warnings, regardless of the form they take, may indicate to an operator that a track or path way ahead is obstructed requiring the operator to initiate an emergency stop of the vehicle, or to otherwise initiate evasive maneuvers to avoid the track or path way obstruction. The warnings may alternatively indicate to the operator that positive control of the vehicle is being externally exercised via the processor 114 to control the vehicle and, for example, to initiate emergency stop or evasive maneuvers for the vehicle. A pushbutton-type action/reset/acknowledge switch may also be provided for indicating the train operator acknowledgement that the tracks are no longer fouled or "All-Clear" signal is sent back to monitoring operators/administration, or ease of use in emergency activation or override situations. The in-cab components may be physically separated, or may be mounted in a particularly designed and fabricated housing for all the components as a "dashboard" style mounting either over or under the vehicle operator's field of view out the windshield of the cab. Using such a dashboard design, when the system is activated, the vehicle operator may see, hear and feel track intrusion indicators, sounders and warnings, see the track bed indicators and platform edge beacons illuminated, and react by applying the brakes, while video is captured in the cab, on the track, and on the platform.

In embodiments, in-cab warning installations may comprise, for example, a modified form of the SPAD that may be triggered under automated control of the system server based on a laser detector scanner unit detection alone, a laser detector scanner unit detection automatically verified by a video analysis of a co-located CCTV feed, or on a manual input form an observer of a situational display unit in any one or more of the RCC, a Station Operator Booth, or other monitoring location. With, for example, a cooperating access node mounted in the vehicle cab, and the indicators and sounders in the cab, an "Emergency Stop" can reach the cab immediately to warn the vehicle operator of impending track fouling involving a customer or object and provide the operator the opportunity and direction to manually apply the brakes in time to prevent disaster. Alternatively, the disclosed scheme may be implemented to take positive automated control of the vehicle and initiate the emergency stop or other evasive maneuvering without operator involvement.

Communications may be established between the fixed radio installations 152,154,156,158 and the RCC 170. These communications may be wired or wireless and may be direct or via some manner of networked communicating environment 160. Establishment of communications between the vehicle radio 112 and the fixed radios 152,154,156,158, with the associated processing of a localization of the vehicle 110 based on those communications, may be translated to the RCC 170. In instances where the vehicle radio 112, or other communicating systems in the vehicle 110, are in contact with the RCC 170, the vehicle radio 112 may be capable of relaying operating conditions for the vehicle including actual speed and heading, as well as range to the next station 140.

The RCC 170 may include one or more RCC situational awareness display units 172, which may be associated with one or more servers that may include video analytics algorithms. The RCC 170 may also include one or more RCC communication components 174 for establishing communication with the fixed radios 152,154,156,158 in the manner described above. The one or more RCC situational awareness display units 172 may be configurable and scalable according to user needs or preferences. The video algorithms analytics associated with the one or more RCC situational awareness display units 172 may rely on an overall CCTV camera deployment for advanced monitoring. Cameras may be mounted as stand-alone units or in combined surveillance and alert units 190,192,194,196. The cameras, for example, may be positioned over the track bed pointing upstream of train traffic, overhead pointing at the platform edge for specific surveillance of that area, or more generally overhead pointing over the platform to capture personnel activity on the platform. Video analytics on the track bed cameras may be employed as a secondary alarm to the laser detector scanner units discussed below. Video content captured may be imported into one or more RCC situational awareness display units 172 under control of an intervening server storing the video analytics schemes in a manner that any particular camera may be associated with one or more specific laser detector scanner units in a manner that may support video pop up of a specific detector in an object detected or alarm status. The video content may also be captured and stored in the server for later use.

The one or more RCC situational awareness display units 172 and the supporting servers may be programmed with an ability to declare mutually inclusive alarm conditions. These mutually inclusive alarm conditions may be generated by the laser detector scanner units and the video analytics of the track bed cameras. The one or more RCC situational awareness display units 172 may automatically dispatch signals initiating alarm conditions to fixed sites in a vicinity of the detected track intrusion. The fixed sites may be provided in the combined surveillance and alert units 190,192,194,196, or in other stand-alone installations in a manner akin to caution light beacons at a vehicle racetrack to alert the vehicle operator to a presence of a track obstruction. The one or more RCC situational awareness display units 172 may alternatively or additionally dispatch signals initiating alarm conditions to appropriate individual vehicle in-cab warning unit(s) 118 and/or control systems activated by processor(s) 114 according to user-preplanned responses and rules sets, typically, via a physical security information manager (PSIM), or an aggregator-type graphical user interface. Track bed and platform edge beacons as visual alarm indicators for the vehicle operator may be activated under automated control of the system server based on a laser detector scanner unit detection alone, a laser detector scanner unit detection automatically verified by a video analysis of a co-located CCTV feed, or on a manual input form an observer of a situational display unit in any one or more of the RCC, a Station Operator Booth, or other monitoring location.

As is described above, a series of trackside or path-side sensors A-X 180-185 may be provided. These sensors A-X 180-185 may be of any appropriate installation including any sensor capable of wide-area surveillance. These sensors A-X 180-185 may include combinations of, for example, laser detector scanner units and/or CCTV camera installations. When configured as laser detector scanner units, the sensors A-X 180-185 may be mounted across the tracks up high and pointing downward at 45 degree angle to, for example, an opposite platform rub rail edge. The platform rub rail edge may provide a clean, straight surface for reflection of the laser beam in order that any object breaking the beam of the laser detector scanner unit may trigger at least and alert to be communicated to the RCC 170 in the manner described above. The laser detector scanner unit may be alternatively mounted with the scan curtain parallel to the ground/track bed at a height where the curtain scans close to the bottom of the opposite platform rub rail edge. This alternative mounting scheme may be more ideal for maintenance, as no ladder is needed to reach the laser detector scanner unit, while maintaining a capacity to scan across the entire track bed.

Optimally, the laser detector scanner unit would include multiple output connections for direct connection to the network and as an IP interface allowing for connections to remote video applications, including via the fixed radio installations 152,154,156,158. Preferably too, the laser detector scanner unit may include one or both of intelligent detection analysis functions and adjustable detection algorithm parameters that increase a range of applications for the laser detector scanner unit. In order to adapt the typical laser detector scanner unit to be transit friendly, the unit may be "hardened" as a sealed unit with a stainless steel housing. A piano hinge style bracket with serrated washers in a clamp style hinge pin may be fully engineered to fit the housing.

By integrating the above COTS systems, a TIDS scheme may be effectively implemented in the manner described in detail above.

By providing an integrated surveillance, detection, communication, alert/warning, and control scheme, the disclosed systems and methods may allow a more robust method for providing time-critical information regarding track or path way obstructions to a vehicle operator in a manner that provides ample time for the vehicle operator to initiate an emergency stop, or to effect other invasive maneuvers, to avoid equipment damage, or personal injury or death, as a vehicle on a known track or within a known path way travels along one or more known tracks or path ways that configure the known track or path way structure.

Figure 2:
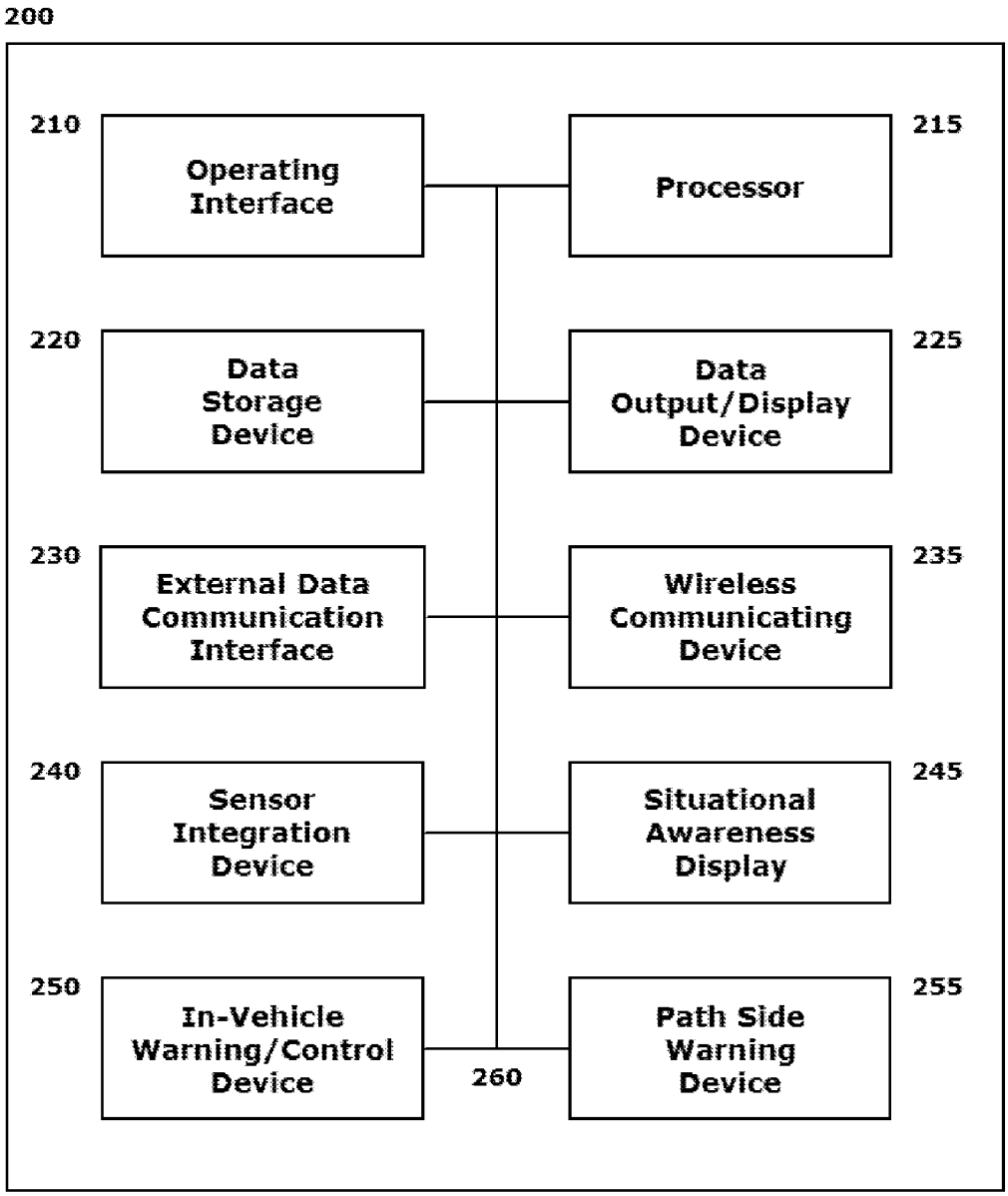
FIG. 2 illustrates an exemplary communication and control system that may implement a vehicle object avoidance scheme for constrained movement vehicles according to this disclosure.

FIG. 2 illustrates an exemplary communication and control system 200 that may implement a vehicle object avoidance scheme for constrained movement vehicles according to this disclosure. The exemplary system 200 shown in FIG. 2 may be implemented as a combination of system components dispersed between a vehicle 110 and an RCC 170, as shown in FIG. 1. In other words, although depicted as a single unit in FIG. 2, and, as will be operated in exemplary embodiments as a single unit, the individual components of the exemplary system 200 may be dispersed in varying locations.

The exemplary system 200 may include an operating interface 210 by which a user may communicate with the exemplary system 200 for directing at least a mode of operation of a vehicle object avoidance scheme. Such modes of operation may include guidance to direct issuing a signal to activate visual or audible warning alarms along a track or path way, and/or in a cab of an oncoming vehicle, based on (1) a single sensor input, (2) a sensor input that is separately verified by a visual analytic, (3) a requirement for input from a user monitoring a situational awareness display 245 to confirm the sensor input, or (4) according to other pre-determined protocol or rules established by the railway or train control or operating agency exercising oversight of operation of the vehicle. In embodiments, the operating interface 210 may be used by the user monitoring the situational awareness display 245 to order the issuance of the signal to activate the visual or audible warning alarms discussed above. The operating interface 210 may be a part of a function of a graphical user interface (GUI) in a situational awareness display 245 located in the RCC.

The exemplary system 200 may include one or more local processors 215 for individually operating the exemplary system 200. The processor 215 may be, for example, a local server for processing inputs from myriad sensors disposed at fixed positions along a track or path way over which monitored operations are undertaken. Processor(s) 215 may execute response schemes, including video analytics algorithms, stored in one or more data storage devices 220, which the processor(s) 215 may reference based on individual sensor detection of an object being determined by the sensor to have broken its beam. Processor(s) 215 may include at least one conventional processor or microprocessor that interprets and executes instructions to establish and/or confirm an instance of the track intrusion and to issue certain alerts and/or warnings via one or more of an in-vehicle warning/control device 250 or path-side warning device 255 based on a position of a vehicle in a vicinity of, and proceeding toward, the instance of the track intrusion. Separately, the processor(s) 215 may, in cooperation and/or communication with processing and control systems on board a vehicle executed through the in-vehicle warning/control device 250, execute certain vehicle control functions such as, for example, initiating emergency braking and/or other evasive maneuvers to avoid an area of, or impact with, an instance of identified and/or verified track intrusion.

The exemplary system 200 may include one or more data storage devices 220. Such data storage device(s) 220 may be used to store data or operating programs to be used by the exemplary system 200, and specifically the processor(s) 215 in carrying into effect the disclosed functions. Data storage device(s) 220 may be used to store information regarding pre-defined or pre-determined strategies, rules, processes or algorithms for receipt, identification and verification of the sensor input regarding a track intrusion event, and specific actions to be undertaken when such a track intrusion event detected and/or verified. Data storage device(s) 220 may also be used to store coincident video information regarding any identified and/or verified track intrusion event.

The data storage device(s) 220 may include a random access memory (RAM) or another type of dynamic storage device that is capable of storing updatable database information, and for separately storing instructions for execution of system operations by, for example, processor(s) 215. Data storage device(s) 220 may also include a read-only memory (ROM), which may include a conventional ROM device or another type of static storage device that stores static information and instructions for processor(s) 215. Further, the data storage device(s) 220 may be integral to any component of the exemplary system 200, or may be provided external to, and in wired or wireless communication with, the exemplary system 200, including cloud-based storage and/or separate server processing elements.

The exemplary system 200 may include at least one data output/display device 225, which may be configured as one or more conventional mechanisms that output information to a user, including, but not limited to, a display screen on a GUI including a situational awareness display 245 in the RCC for displaying information regarding operation of the vehicle including, but not limited to, current speed and any detected track intrusion event. The data output/display device 225 may be used to indicate operating conditions or modes of the track intrusion detection scheme and control functions that may be carried into effect by the exemplary system 200.

The exemplary system 200 may include at least one external data communication interface 230 by which the exemplary system 200 may communicate with external systems for effecting the disclosed schemes.

The exemplary system 200 may include a wireless communicating device 235. In instances where the exemplary system 200 is mounted completely or predominantly within the RCC, the wireless communicating device 235 may be used to establish communication with one or more fixed sites along the track or path to which movement of the vehicle is constrained for localizing a position of the vehicle and for passing alert and/or control information to the in-vehicle warning/control device 250, and/or to a path-side warning device 255.

The exemplary system 200 may include a sensor integration device 240 by which the exemplary system 200 may receive sensor inputs from a network of sensors including, for example, a plurality of laser detector scanner units positioned at certain intervals along a monitored track or path way, and/or a plurality of cameras, including CCTV cameras located at strategic points along the monitored track or path way to provide visual security and/or verification of track intrusion alarms generated by one or more of the plurality of laser detector scanner units. Integrated information received and collated by the sensor integration device 240 may be provided to one or more situational awareness display(s) 245 to provide feedback to a user in, for example, an RCC in which the situational awareness display(s) 245 may be located to identify unsafe conditions, including track intrusion events.

All of the various components of the exemplary system 200, as depicted in FIG. 2, may be connected internally, and potentially to a processing device such as, for example, in a server in the RCC, by one or more data/control busses 260. These data/control busses 260 may provide wired or wireless communication between the various components of the exemplary system 200, whether all of those components are housed integrally in, or are otherwise external and connected to, other components of track intrusion detection system (including the RCC) with which the exemplary system 200 may be associated.

It should be appreciated that, although depicted in FIG. 2 as an essentially integral unit, the various disclosed elements of the exemplary system 200 may be arranged in any combination of sub-systems as individual components or combinations of components, integral to a single unit, or external to, and in wired or wireless communication with, the single unit of the exemplary system 200. In other words, no specific configuration as an integral unit or as a support unit is to be implied by the depiction in FIG. 2. Further, although depicted as individual units for ease of understanding of the details provided in this disclosure regarding the exemplary system 200, it should be understood that the described functions of any of the individually-depicted components may be undertaken, for example, by one or more processors 215 connected to, and in communication with, one or more data storage device(s) 220, all of which may support operations in the associated track intrusion detection system.

Figure 3:
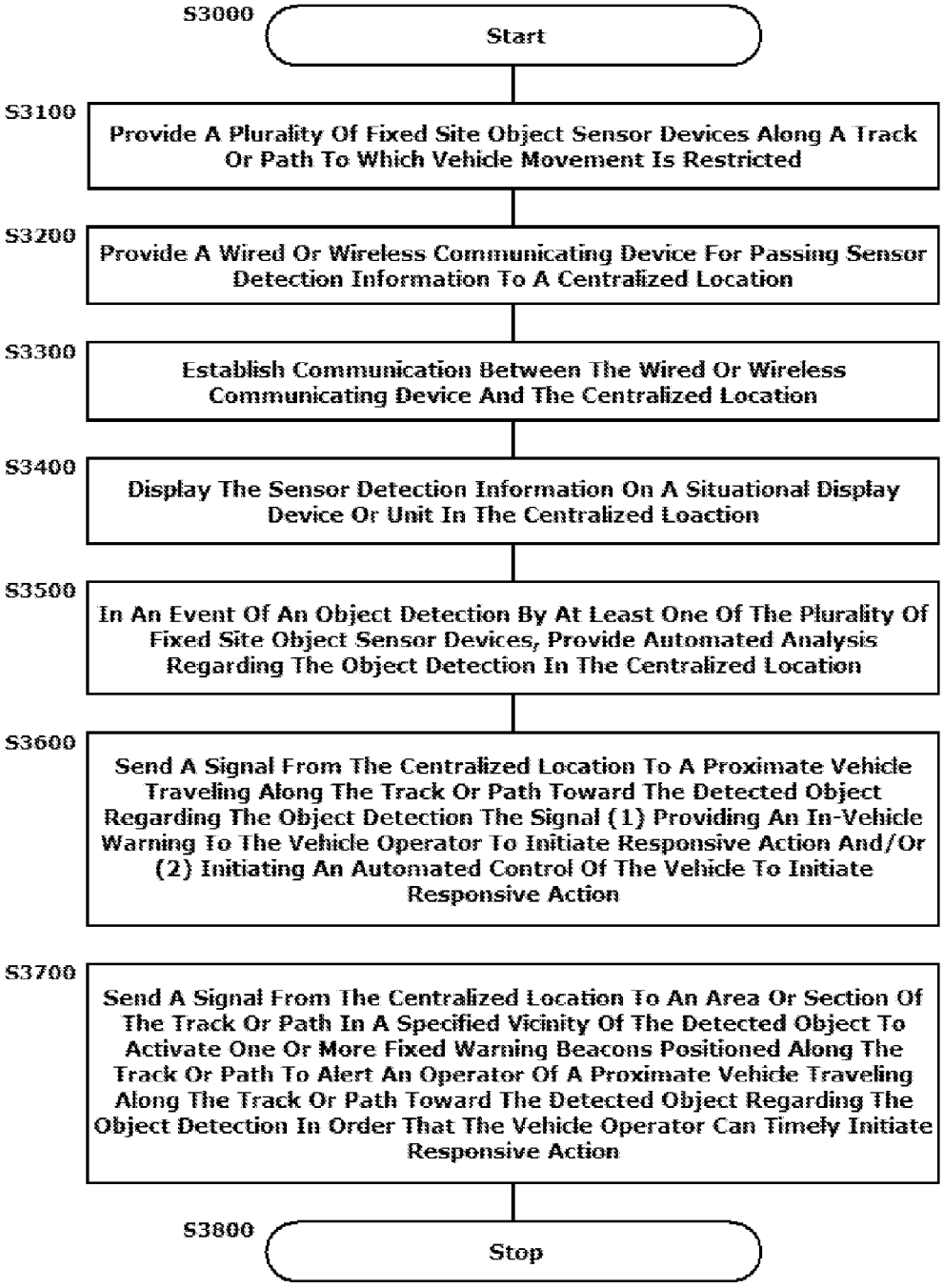
FIG. 3 illustrates a flowchart of an exemplary method for effecting a vehicle object avoidance scheme for constrained movement vehicles according to this disclosure.

The disclosed embodiments may include an exemplary method for effecting a vehicle object avoidance scheme for constrained movement vehicles according to this disclosure. FIG. 3 illustrates an exemplary flowchart of such a method. As shown in FIG. 3, operation of the method commences at Step S3000 and proceeds to Step S3100.

In Step S3100, a plurality of fixed site object detection sensor devices may be provided along a track or path to which movement of a particular vehicle is restricted. Operation of the plurality of fixed site object sensor devices may be as described above. Operation of the method proceeds to Step S3200.

In Step S3200, a network of wired or wireless communicating devices may be provided for passing sensor detection information to a centralized location such as, for example, an RCC, as described above. The network of wired or wireless communicating devices may include, for example, at least one wireless communicating device provided in the vehicle whose movement is restricted to the track or path and a plurality of fixed site cooperating wireless communicating devices positioned at intervals along the track or path. The at least one wireless communicating device provided in the vehicle and each of the plurality of fixed site wireless communicating devices positioned along the track or path may have a unique identifier to aid in localizing a position of the vehicle as it passes the plurality of fixed site wireless communicating devices, and for ensuring that targeted communication may be directed to individual vehicles. Operation of the method proceeds to Step S3300.

In Step S3300, communication may be established between at least one of the fixed site wireless communicating devices and the at least one wireless communicating device in the vehicle, and communication in turn may be established between the at least one of the fixed site wireless communicating devices and the centralized location. Operation of the method proceeds to Step S3400.

In Step S3400, sensor detection information may be displayed on a situational display device or unit in the centralized location. The sensor detection information, in a nominal state, may simply include video feeds from one or more CCTVs and/or an operating status of one or more sensor units, including a plurality of laser detector scanner units. Operation of the method proceeds to Step S3500.

In Step S3500, an object may be detected by at least one of the plurality of fixed site object sensor devices. In the event, or on the occasion, of such an object detection by at least one of the plurality of fixed site object sensor devices, an automated analysis of information related to the object attention may be independently evaluated at the centralized location. Operation of the method proceeds to Step S3600.

In Step S3600, as a result of the object detection, or the automated analysis, a signal may be sent from the centralized location to one or more specific proximate vehicles traveling along the track or path toward an area in which the object was detected. The signal may provide an in-vehicle warning to the vehicle operator to initiate response, e.g., an emergency stop or other evasive maneuver, to avoid the detected object. The signal may also or alternatively provide input to a vehicle-mounted processor or positive vehicle control device to initiate an automated control of the vehicle that carries into effect an emergency stop or other evasive maneuver by the vehicle to avoid the detected object. Operation of the method proceeds to Step S3700.

In Step S3700, as a result of the object detection, or the automated analysis, a signal may be sent from the centralized location to one or more fixed signaling devices associated with one or more track sections in an area in which the object was detected. The signal may be provided in the form of a warning beacon emanating from a fixed position along the track bed, associated with a platform, at a tunnel opening, or otherwise positioned in a field of view of an operator approaching the one or more track sections to provide an external warning to the vehicle operator to initiate response, e.g., an emergency stop or other evasive maneuver, to avoid the detected object. Operation of the method proceeds to Step S3800, where operation of the method ceases.

The disclosed embodiments may include a non-transitory computer-readable medium storing instructions which, when executed by a processor, may cause the processor to execute all, or at least some, of the functions to implement the steps of the method outlined above.

The above-described exemplary systems and methods reference certain conventional components to provide a brief, general description of suitable operating environments in which the subject matter of this disclosure may be implemented for familiarity and ease of understanding. Although not required, embodiments of the disclosed systems, and implementations of the disclosed methods, may be provided and executed, at least in part, in a form of hardware circuits, firmware, or software computer-executable instructions to carry out the specific functions described. These may include individual program modules executed by one or more processors. Generally, program modules include routine programs, objects, components, data structures, and the like that perform particular tasks or implement particular data types in support of the overall objective of the systems and methods according to this disclosure. Certain of the system and processing components may be non-transitory system components that are cloud based.

Those skilled in the art will appreciate that other embodiments of the disclosed subject matter may be practiced in integrating object detection components, communication components and fixed site or in-cab warning (and/or vehicle control) components for vehicles traveling on constrained tracks or paths using many and widely varied COTS system components.

As indicated above, embodiments within the scope of this disclosure may include computer-readable media having stored computer-executable instructions or data structures that can be accessed, read and executed by one or more processors in differing devices, as described. Such computer-readable media may be any available media that can be accessed by a processor, general purpose or special purpose computer to carry into effect the instructions recorded thereon. By way of example, and not limitation, such computer-readable media can comprise RAM, ROM, EEPROM, CD-ROM, flash drives, data memory cards or other analog or digital data storage devices that can be used to carry or store desired program elements or steps in the form of accessible computer-executable instructions or data structures. When information is transferred or provided over a network or another communications connection, whether wired, wireless, or in some combination of the two, the receiving processor properly views the connection as a computer-readable medium. Thus, any such connection is properly termed a computer-readable medium. Combinations of the above should also be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions, or associated data structures, represents one example of a corresponding sequence of acts for implementing the functions described in the steps of the above-outlined exemplary method. The exemplary depicted steps may be executed in any reasonable order to carry into effect the objectives of the disclosed embodiments. No particular order to the disclosed steps of the method is necessarily implied by the depiction in FIG. 3, except where execution of a particular method step is a necessary precondition to execution of any other method step. Although the above description may contain specific details, they should not be construed as limiting the claims in any way. Other configurations of the described embodiments of the disclosed systems and methods are part of the scope of this disclosure. It will be appreciated that various of the above-disclosed and other features and functions, or alternatives thereof, may be desirably combined into many other different systems or applications. Although the above description may contain specific details, they should not be construed as limiting the claims in any way. Other configurations are part of the scope of the disclosed embodiments. For example, the principles of the disclosed embodiments may be applied to each individual vehicle that may individually reliably employ components of the disclosed system or autonomous or system-wide vehicle track intrusion detection. This enables each user vehicle to enjoy the benefits of the disclosed embodiments even if any one of the large number of possible user vehicle applications do not need some portion of the described functionality. In other words, there may be multiple instances of the disclosed system each processing the content in various possible ways. It does not necessarily need to be one system used by all end user vehicles. Accordingly, the appended claims and their legal equivalents should only define the disclosed embodiments, rather than any specific examples given.

I claim:

1. A system for avoiding an object in a vehicle path, comprising:

a plurality of object sensors placed in fixed locations along a path to which vehicle movement is constrained, each of the object sensors being a laser scanner unit projecting a beam of laser energy across the vehicle path to a reflector on an opposite side of the vehicle path from the laser scanner unit;

at least one remote monitoring unit for collecting information from the plurality of object sensors; and at least one automated warning device to alert a vehicle operator regarding a presence of an object in the vehicle path, the at least one remote monitoring unit generating a signal to activate the at least one automated warning device based on an analysis of the collected information from at least one of the plurality of object sensors that an object breaks the beam of laser energy projected across the vehicle path.

2. The system of claim 1, the at least one of the plurality of object sensors communicating a positive detection result to the at least one remote monitoring unit.

3. The system of claim 2, the at least one remote monitoring unit further comprising a processor that is programmed to execute a video analytic algorithm that receives inputs from one or more closed circuit television cameras positioned in an area of the positive detection result;

verifies the positive detection result based on the received inputs; and commands the signal to activate the at least one automated warning device to be generated only as a result of the verified positive detection.

4. The system of claim 3, the at least one remote monitoring unit comprising a situational awareness display component.

5. The system of claim 4, the signal being generated by manual action of a user monitoring the situational awareness display component.

6. The system of claim 1, further comprising:

one or more first wireless communicating devices mounted at fixed locations along the vehicle path; and a second wireless communicating device associated with the vehicle, the second wireless communicating device independently establishing communication with the one or more first wireless communicating devices as the vehicle traverses the vehicle path.

7. The system of claim 6, the one or more first wireless communicating devices and the second wireless communicating device providing a communication link between at least some of the plurality of object sensors, the remote monitoring unit and the vehicle.

8. The system of claim 1, the at least one warning device comprising an in-vehicle warning device, the in-vehicle warning device being at least one of a visual warning device, an audio warning device and a haptic warning device.

9. The system of claim 1, the at least one warning device comprising one or more fixed site warning devices mounted along the vehicle path, the one or more fixed site warning devices being at least one of a visual warning device and an audio warning device.

10. A method for avoiding an object in a vehicle path, comprising:

receiving an indication of an object in a vehicle path from at least one of plurality of object sensors placed in fixed locations along a path to which vehicle movement is constrained, each of the object sensors being a laser scanner unit projecting a beam of laser energy across the vehicle path to a reflector on an opposite side of the vehicle path from the laser scanner unit;

analyzing the received indication with at least one remote monitoring unit that collects information from the plurality of object sensors; and generating a signal to activate at least one automated warning device to alert a vehicle operator regarding a presence of the object in the vehicle path based on the analysis detecting that an object breaks the beam of laser energy projected across the vehicle path.

11. The method of claim 10, the indication of the object in the vehicle path being communicated from at least one of the laser scanner units to the at least one remote monitoring unit as a positive detection result.

12. The method of claim 11, the analyzing comprising executing a video analytic algorithm to verify the positive detection result with inputs from one or more closed circuit television cameras positioned in an area of the positive detection result, the signal being generated automatically as a result of the verified positive detection.

13. The method of claim 12, further comprising displaying the positive detection result on a situational awareness display component that is monitored by a user.

14. The method of claim 13, the signal being generated by manual action of the user monitoring the situational awareness display component.

15. The method of claim 10, further comprising establishing communication between one or more first wireless communicating devices mounted at fixed locations along the vehicle path and a second wireless communicating device associated with the vehicle independently as the vehicle traverses the vehicle path, the one or more first wireless communicating devices and the second wireless communicating device providing a communication link between at least some of the plurality of object sensors, the remote monitoring unit and the vehicle.

16. The method of claim 10, the at least one warning device comprising an in-vehicle warning device, the in-vehicle warning device being at least one of a visual warning device, an audio warning device and a haptic warning device.

17. The method of claim 10, the at least one warning device comprising one or more fixed site warning devices mounted along the vehicle path, the one or more fixed site warning devices being at least one of a visual warning device and an audio warning device.

* * * * *